US010435778B2

(12) United States Patent
Utsumi et al.

(10) Patent No.: US 10,435,778 B2
(45) **Date of Patent: *Oct. 8, 2019**

(54) SURFACE TREATING APPARATUS

(71) Applicant: C. Uyemura & Co., Ltd., Osaka (JP)

(72) Inventors: Masayuki Utsumi, Osaka (JP); Hisamitsu Yamamoto, Osaka (JP); Syunsaku Hoshi, Osaka (JP); Junji Mizumoto, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/600,928

(22) Filed: May 22, 2017

(65) Prior Publication Data

US 2018/0087140 A1 Mar. 29, 2018

(30) Foreign Application Priority Data

Sep. 27, 2016 (JP) ..... 2016-188588

(51) Int. Cl.

| | |
|---|---|
| ***C23C 4/12*** | (2016.01) |
| ***B05C 3/09*** | (2006.01) |
| ***B05B 12/16*** | (2018.01) |
| ***C23C 4/02*** | (2006.01) |
| ***C23C 4/04*** | (2006.01) |

(Continued)

(52) U.S. Cl.

CPC ..... *C23C 4/12* (2013.01); *B05B 12/16* (2018.02); *B05B 13/0264* (2013.01); *B05C 3/09* (2013.01); *C23C 4/02* (2013.01); *C23C 4/04* (2013.01); *B05B 1/044* (2013.01); *B05B 15/58* (2018.02)

(58) Field of Classification Search

USPC ..... 118/423, 426, 428, 429; 204/198

See application file for complete search history.

(56) References Cited

U.S. PATENT DOCUMENTS

| | | | |
|---|---|---|---|
| 3,876,510 | A | 4/1975 | Wallin et al. |
| 4,427,019 | A | 1/1984 | Eidschun |

(Continued)

FOREIGN PATENT DOCUMENTS

| | | | |
|---|---|---|---|
| JP | S57-94571 | | 6/1982 |
| JP | 10251897 | A * | 9/1998 |

(Continued)

OTHER PUBLICATIONS

Official Action (Restriction Requirement) for U.S. Appl. No. 13/951,947, dated Oct. 9, 2014.

(Continued)

*Primary Examiner* — Yewebdar T Tadesse

(74) *Attorney, Agent, or Firm* — Jason H. Vick; Sheridan Ross, PC

(57) ABSTRACT

A device capable of performing surface treatment evenly to an upper portion of a substrate is provided. An upper end of a substrate 54 is sandwiched and held by a clip 52 of a hanger 50. A pipe 56 as a treatment solution releasing section is provided on each side of the substrate 54 that is held by the hanger 50. This pipe 56 is provided with a hole 58 from which the treatment solution is released obliquely upward. The released treatment solution flows down on a surface of the substrate 54, reaches a lower portion thereof, is circulated by a pump 60, and is released from the pipe 56 again.

11 Claims, 23 Drawing Sheets

(51) Int. Cl.

| | |
|---|---|
| ***B05B 13/02*** | (2006.01) |
| *B05B 1/04* | (2006.01) |
| *B05B 15/58* | (2018.01) |

(56) References Cited

U.S. PATENT DOCUMENTS

| | | | |
|---|---|---|---|
| 2007/0108044 | A1 | 5/2007 | Okuda et al. |
| 2014/0053774 | A1 | 2/2014 | Hotta et al. |
| 2014/0116334 | A1 | 5/2014 | Hotta et al. |

FOREIGN PATENT DOCUMENTS

| | | | | |
|---|---|---|---|---|
| JP | 2002-363796 | | | 12/2002 |
| JP | 2004-339590 | A | | 12/2004 |
| JP | 2004339590 | A | * | 12/2004 |
| JP | U 3115047 | | | 9/2005 |
| JP | 2006-118019 | | | 5/2006 |
| JP | 2010-189736 | | | 9/2010 |
| JP | 2011-032538 | | | 2/2011 |
| JP | 2014-43613 | A | | 3/2014 |
| JP | 2014-88600 | A | | 5/2014 |

OTHER PUBLICATIONS

Official Action for U.S. Appl. No. 13/951,947 dated Dec. 17, 2014.
Official Action for U.S. Appl. No. 13/951,947 dated May 4, 2015.
Notice of Allowance for U.S. Appl. No. 13/951,947 dated Jun. 25, 2015.
Notification of Reasons for Refusal (Including Translation) for Japanese Patent Application No. 2016-188588, dated Jul. 17, 2018.

* cited by examiner

SURFACE TREATING APPARATUS

CROSS REFERENCE TO RELATED APPLICATIONS

This application claims the benefit under 35 U.S.C. 119(a) to Japanese Patent Application No. JP 2016-188588, filed Sep. 27, 2016, the entire disclosure of which is incorporated herein by reference in its entirety.

BACKGROUND OF THE INVENTION

1. Field of the Invention

The invention relates to a technique of performing surface treatment such as plating on a thin plate.

2. Description of the Related Art

When surface treatment such as plating is performed on a substrate and the like, it has been common to use a method of immersing the substrate in a plating bath that is filled with a plating solution. This method requires a lifting mechanism to lift and lower the substrate, which leads to a problem of complication and enlargement of a device. In addition, the plating bath has to be filled with the plating solution, which leads to a problem of requiring a large quantity of the plating solution. These problems are not only inherent in plating but are common to the surface treatment as a whole. Note that the surface treatment includes treatment of a surface of a target such as electroless plating, electroplating, displacement plating, displacement reduction plating, zincate treatment, pretreatment, post treatment, desmear, catalyst-imparting, activator, accelerator, etching, and various types of cleaning.

In order to solve such problems, the inventors have invented a device that releases a treatment solution to the substrate whose upper portion is held, collects the treatment solution dropped from the substrate, and releases the treatment solution again (JP-A-2014-88600, JP-A-2014-43613).

FIG. 22 shows a surface treatment device disclosed in JP-A-2014-88600. An upper portion of a substrate 2 is held by a hanger 6 as a holding member. A mobile body 14 that holds the hanger 6 is held by a roller 16, and moves in a perpendicular direction to the sheet. The substrate 2 is introduced into a body 4. In the body 4, a treatment solution releasing section 8 that has a treatment solution jet port 10 is provided on each side of the substrate 2.

The treatment solution is jetted to the substrate 2 from the treatment solution jet port 10, and the treatment solution that has reached the substrate 2 flows down on a surface of the substrate 2. In this way, the surface of the substrate 2 is treated by the treatment solution.

The treatment solution that has run down is collected in a lower portion of the body 4 and is released again from the treatment solution releasing section 8 by a pump 12.

In this way, a reduction in use of the treatment solution is realized without enlarging and complicating the device.

In the above related art, the released treatment solution is applied to the substrate 2 and flows down. Thus, such a problem is raised that a portion of the substrate 2 above a position applied with the treatment solution cannot be subjected to the surface treatment and becomes useless.

Furthermore, it is difficult to keep a force of releasing the treatment solution to be constant, which leads to such a problem that the position of the substrate 2 applied with the treatment solution varies and thus the position in the upper portion of the substrate that is subjected to the surface treatment also varies.

The invention solves the above problems and therefore has a purpose of providing a device capable of thoroughly performing surface treatment to an upper portion of a substrate.

SUMMARY OF THE INVENTION

Several features of a surface treatment device according to the present invention that are independently applicable will be listed below.

(1) The surface treatment device according to the present invention including: a holding member that holds an upper portion of a treatment target; a treatment solution releasing section that releases a treatment solution to the holding member and causes the treatment solution to flow on a surface of the treatment target held by the holding member; and a transferring mechanism that changes a relative position of the treatment target, which is held by the holding member, to the treatment solution releasing section.

Accordingly, the surface treatment using the treatment solution can be further evenly performed to the upper portion of the treatment target held by the holding member.

(2) The surface treatment device according to the present invention wherein at least a part of the holding member has such thickness that, when flowing on a surface of the holding member toward the treatment target, the released treatment solution flows perpendicularly with respect to the surface of the treatment target and reaches the treatment target.

Accordingly, the treatment solution is introduced to the surface of the treatment target in a substantially perpendicular direction. Thus, an agent that is applied to the surface of the treatment target can be prevented from being rinsed off for more than necessary.

(3) The surface treatment device according to the present invention, in which a corner of a lower end of the holding member that holds the treatment target has a curved surface shape in a cross section.

Accordingly, a flow of the treatment solution can be smoothly guided from the holding member toward the treatment target.

(4) The surface treatment device according to the present invention, in which a lower end of the holding member that holds the treatment target has a semi-circular shape in a cross section.

Accordingly, a curved surface portion can be configured by cutting a member such as a round rod in half.

(5) The surface treatment device according to the present invention, in which a plurality of the holding members is provided and is configured that the treatment targets are transferred with a specified space being interposed therebetween, and the plurality of the holding members is configured that the treatment solution also flows through the space between the treatment targets.

Accordingly, the surface treatment with little unevenness can be performed even at an end of the treatment target.

(6) The surface treatment device according to the present invention, in which the plurality of the holding members is configured that the holding member is also located in an upper portion of the space between the adjacent treatment targets.

Accordingly, the treatment solution can also flow through the space between the treatment targets.

(7) The surface treatment device according to the present invention, in which the plurality of the holding members is configured that an end of the treatment target overlaps a part of the adjacent holding member.

Accordingly, the treatment solution can also flow through the space between the treatment targets without increasing a gap between the treatment targets.

(8) The surface treatment device according to the present invention, in which a guide is provided at an end of the holding member such that the treatment solution flows toward the treatment target held by the adjacent holding member.

Accordingly, the treatment solution can flow through the space between the treatment targets without increasing the gap between the treatment targets.

(9) The surface treatment device according to the present invention, in which the treatment target is a thin plate, and the holding member is configured to sandwich the thin plate from both sides, is provided with gripping projections to sandwich the thin plate on inner sides, and is provided with an adhesion prevention projection to avoid adhesion of the thin plate to the holding member.

Accordingly, the adhesion of the thin plate to the holding member can be prevented, and thus uneven treatment can be prevented.

(10) The surface treatment device according to the present invention, in which the treatment solution releasing section is provided at a plurality of positions in a transferring direction of the treatment target, at least one of the treatment solution releasing sections releases a plating solution, and at least another one thereof releases a cleaning solution, and the treatment solution releasing sections are configured that a position where the treatment solution releasing section releasing the plating solution applies the plating solution to the holding member is lower than a position where the treatment solution releasing section releasing the cleaning solution applies the cleaning solution to the holding member.

Accordingly, the plating solution adhering to the holding member can be efficiently rinsed off by the cleaning solution.

(11) A surface treatment method according to the present invention including: holding an upper portion of a treatment target; and releasing a treatment solution to a position above an upper end of the treatment target, causing the treatment solution to flow on a surface of the treatment target, and thereby treating the surface of the treatment target.

Accordingly, the surface treatment using the treatment solution can be further evenly performed to the upper portion of the treatment target.

(12) The surface treatment device according to the present invention is a surface treatment device including: a holding member that holds an upper portion of a treatment target; a treatment solution releasing section that causes a treatment solution to flow on a surface of the treatment target held by the holding member; and a transferring mechanism that changes a relative position of the treatment target held by the holding member with respect to the treatment solution releasing section, in which a plurality of the holding members is provided and is configured that the treatment targets are transferred with a specified space being interposed therebetween, and it is configured that the treatment solution also flows through the space between the treatment targets.

Accordingly, uneven treatment can be prevented by causing the treatment solution to flow through the space between the treatment targets.

(13) The surface treatment device according to the present invention is a surface treatment device including: a holding member that holds an upper portion of a thin plate as a treatment target; a treatment solution releasing section that causes a treatment solution to flow on a surface of the thin plate held by the holding member; and a transferring mechanism that changes a relative position of the treatment target held by the holding member to the treatment solution releasing section, in which the holding member is configured to sandwich the thin plate from both sides, is provided with gripping projections to sandwich the thin plate on inner sides, and is provided with adhesion prevention projections to avoid adhesion of the thin plate to the holding member.

Accordingly, the adhesion of the thin plate to the holding member can be prevented, and thus the uneven treatment can be prevented.

The features of the present invention can be described broadly as set forth above. The structures and characteristics of the present invention will be apparent from the following detailed description of the present invention together with those features, effects, and drawings.

DESCRIPTION OF THE PREFERRED EMBODIMENTS

1. First Embodiment

Figure 1:
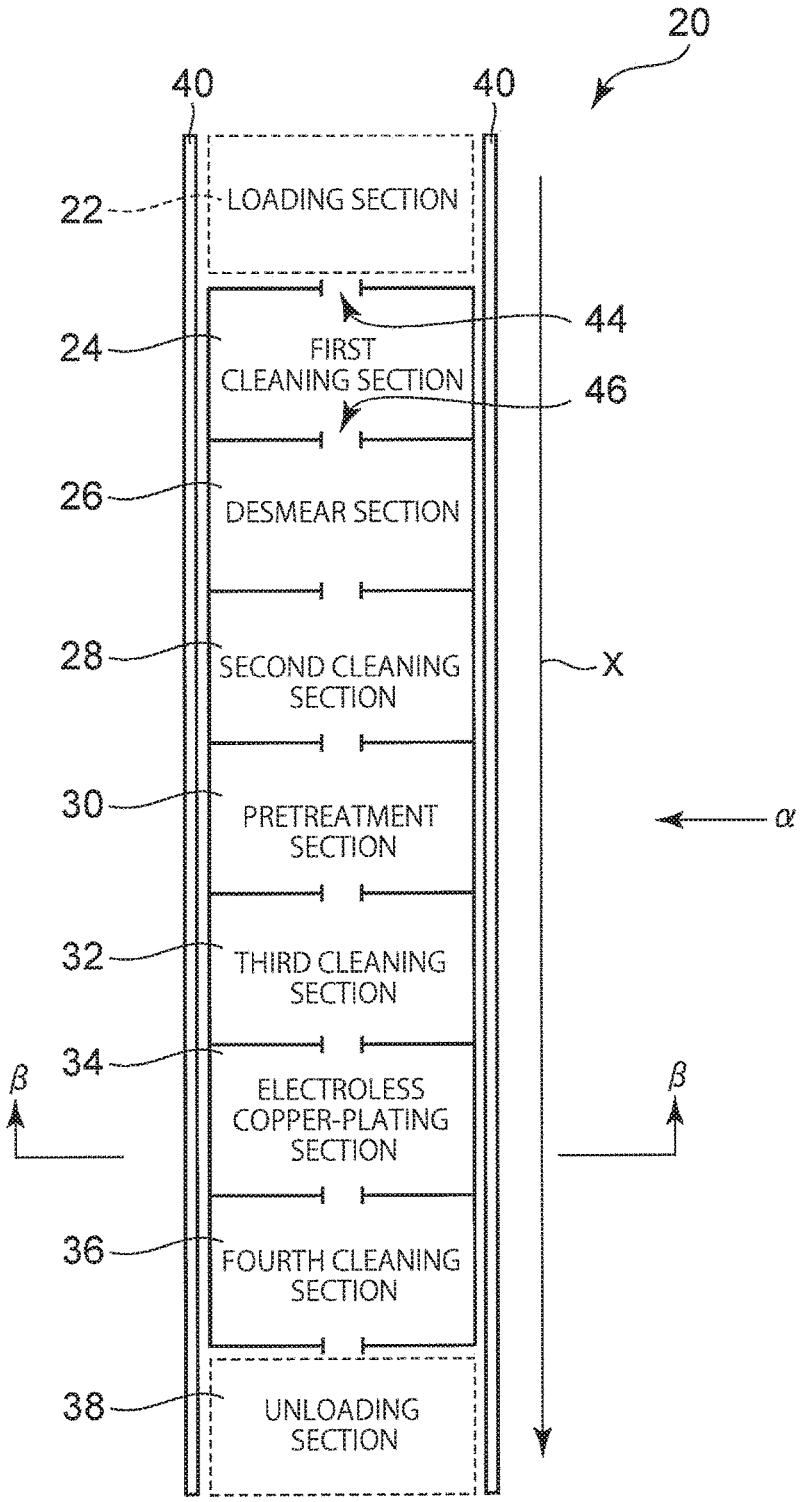
FIG. 1 is an overall configuration diagram of a surface treatment system according to one embodiment of the present invention.

FIG. 1 is a plan view of a surface treatment system 20 according to one embodiment of the present invention. This surface treatment system 20 includes plural surface treatment sections. More specifically, the surface treatment system 20 includes a first cleaning section 24, a desmear section 26, a second cleaning section 28, a pretreatment section 30, a third cleaning section 32, an electroless copper-plating section 34, and a fourth cleaning section 36. Each of the treatment sections is provided with an entry 44 and an exit 46, and a substrate moves in an X-direction through these openings. A group of rollers 40, 40, each of which holds a hanger (not shown) for transporting the substrate in a manner to allow sliding thereof, is provided on outer sides of each of the treatment sections.

Figure 2:
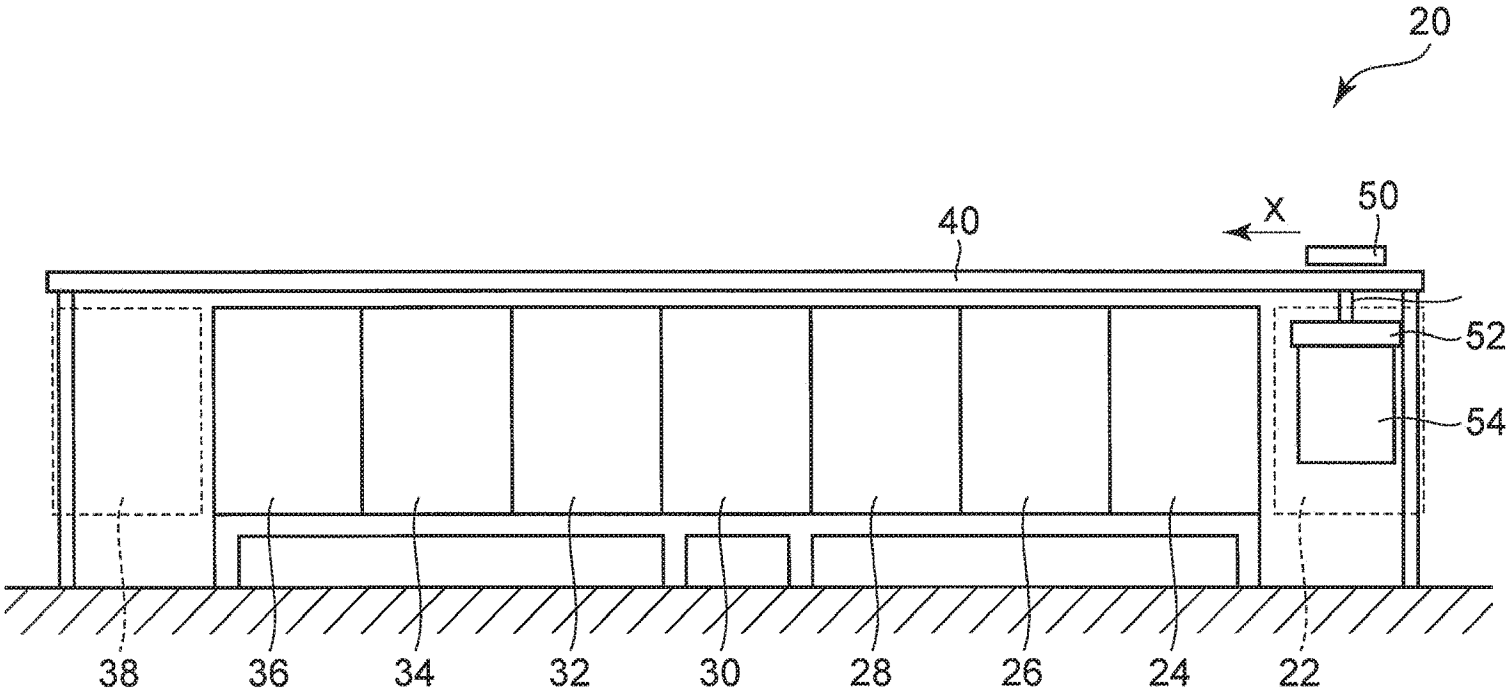
FIG. 2 is a side view of the surface treatment system in FIG. 1.

FIG. 2 is a view that is seen from an α-direction in FIG. 1. The surface treatment is performed on a substrate 54 that is held by a clip 52 of a hanger 50 as a holding member in an order of the first cleaning section 24, the desmear section 26, the second cleaning section 28, the pretreatment section 30, the third cleaning section 32, the electroless copper-plating section 34, and the fourth cleaning section 36.

Figure 3:
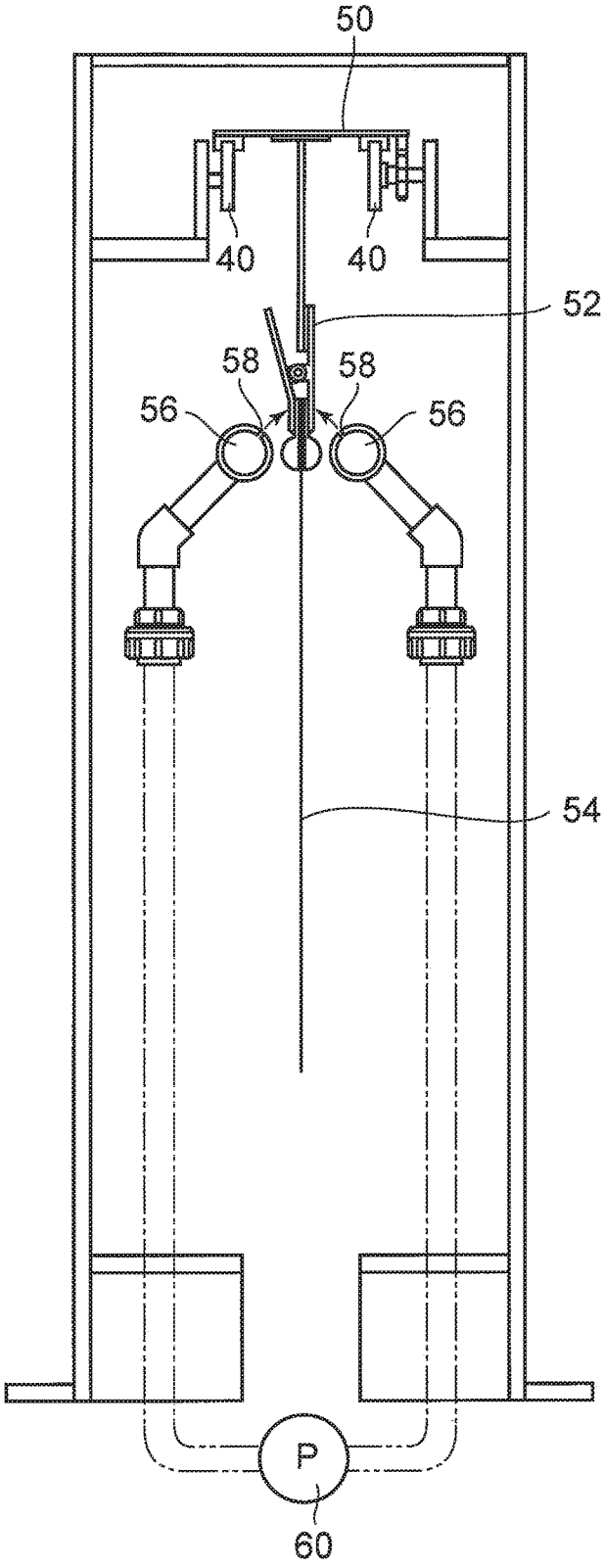
FIG. 3 is a cross-sectional view of the surface treatment device.

FIG. 3 is a cross-sectional view taken along β-β in FIG. 1. An upper end of the substrate 54 is sandwiched and held by the clip 52 of the hanger 50. A pipe 56 as a treatment solution releasing section is provided on each side of the substrate 54 that is held by the hanger 50. Each of these pipes 56 is provided with a hole 58 through which the treatment solution is released obliquely upward. The released treatment solution flows down on a surface of the substrate 54, reaches a lower portion thereof, is circulated by a pump 60, and is released again from the pipe 56.

Figure 4:
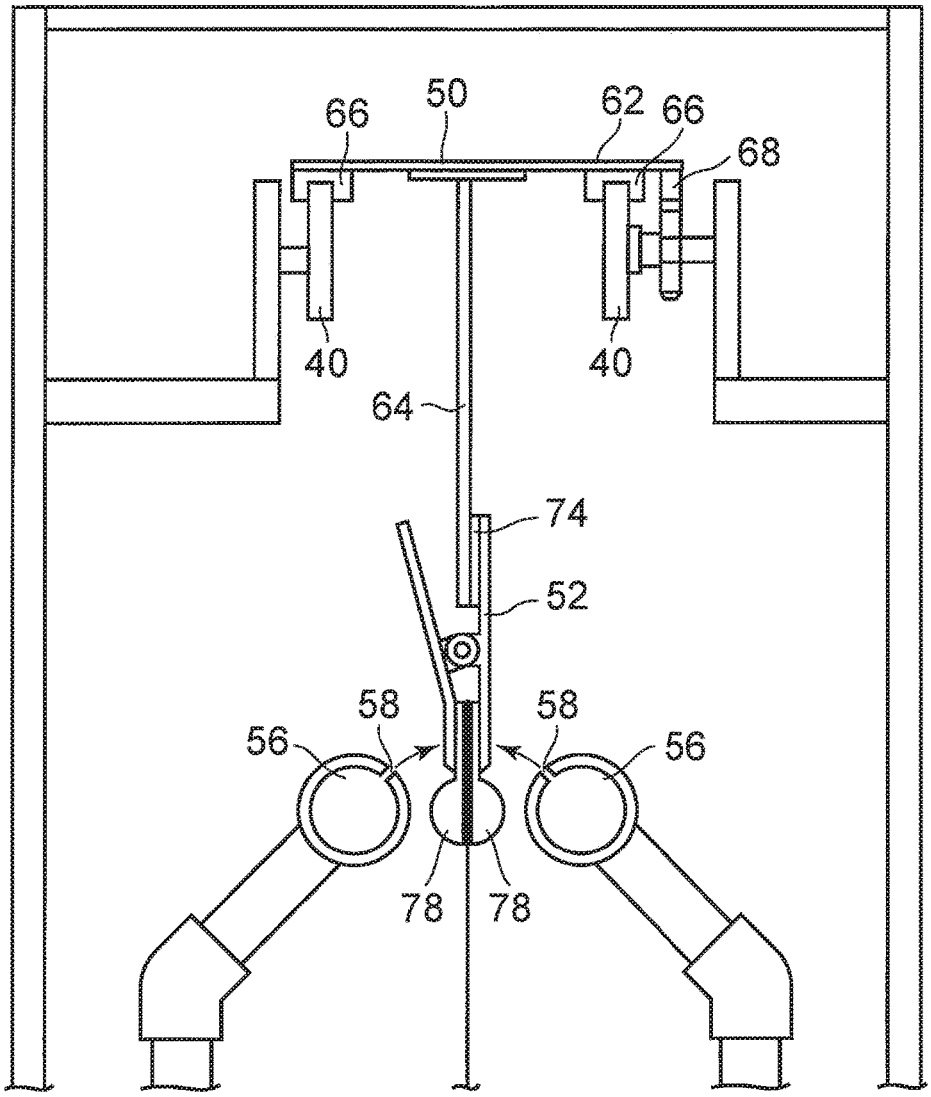
FIG. 4 is a detailed view of a portion near a hanger 50.

FIG. 4 is a detailed view of a portion near the hanger 50. The hanger 50 includes a top plate 62, a hanging plate 64 that extends in a downward direction from this top plate 62, and a clip holding member 74 that is fixed to the hanging plate 64. The clip holding member 74 is provided with the clip 52.

Figure 6:
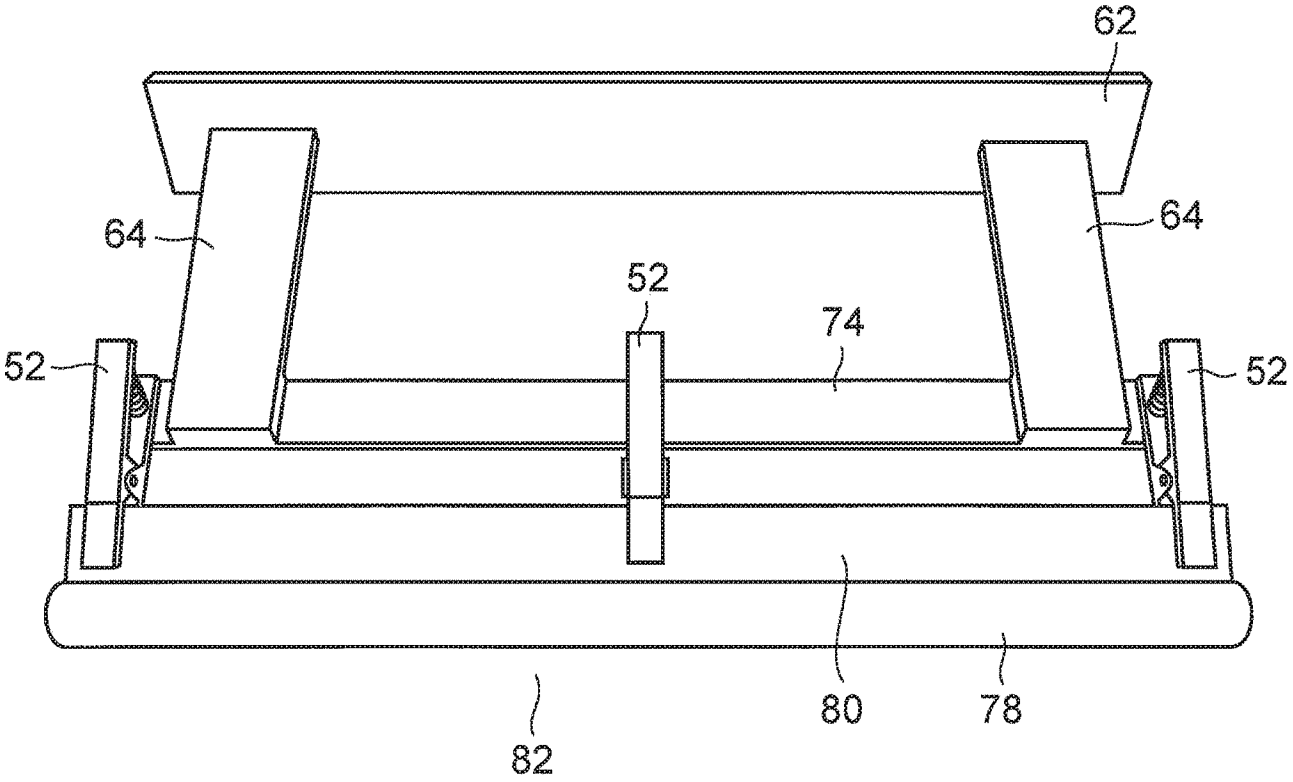
FIG. 6 is a view of the hanger 50.

FIG. 6 is a perspective view of the hanger 50. The hanging plates 64 extend in the downward direction from the top plate 62. The clip holding member 74 is fixed in a lateral direction to these hanging plates 64. The clips 52 are provided on both ends and a central portion of this clip holding member 74.

Figure 7:
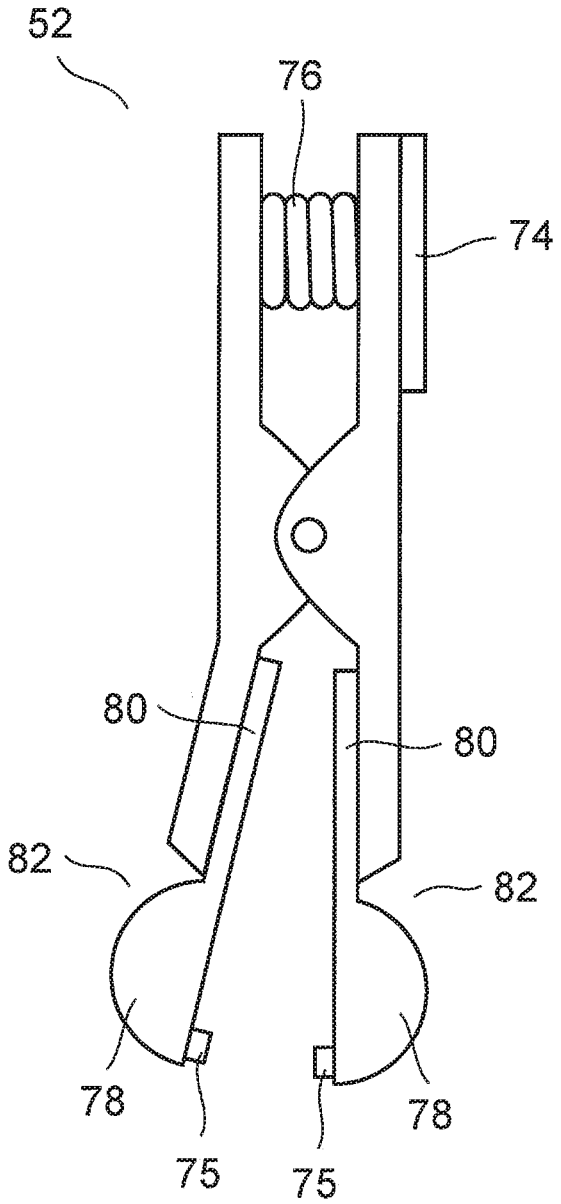
FIG. 7 is a view of a clip 52.

FIG. 7 is a detailed view of the clip 52. The clip 52 is urged in a direction of closing a tip thereof by a spring 76. FIG. 7 shows a state where the spring 76 is pressed against this spring 76 so as to open the tip. As shown in FIG. 6, at the tips of the clips 52, a treatment solution receiving member 82 is provided across entire width of the hanger 50. As shown in FIG. 7, the treatment solution receiving member 82 has a flat plate 80 in a root portion thereof and has a projected section 78 in a semicircular shape (preferably with a radius of 20 mm to 40 mm) that is projected outward at the tip thereof. Gripping projections 75 that sandwich and grip the substrate 54 therebetween are provided at lower inner ends of the projected sections 78.

Figure 11A:
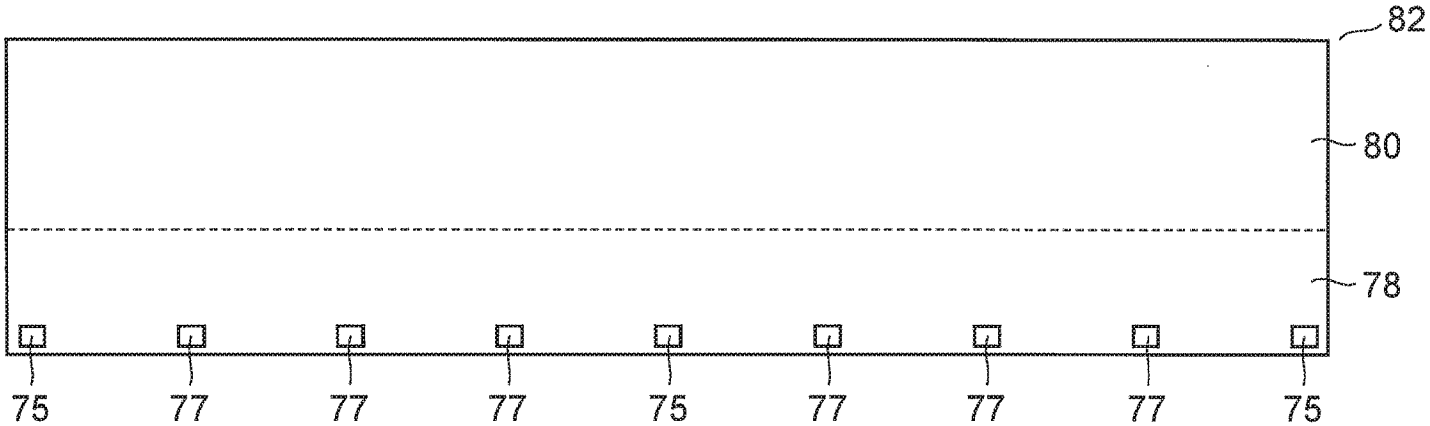
FIGS. 11A and 11B include views of an internal structure of the treatment solution receiving member 82.
Figure 11B:
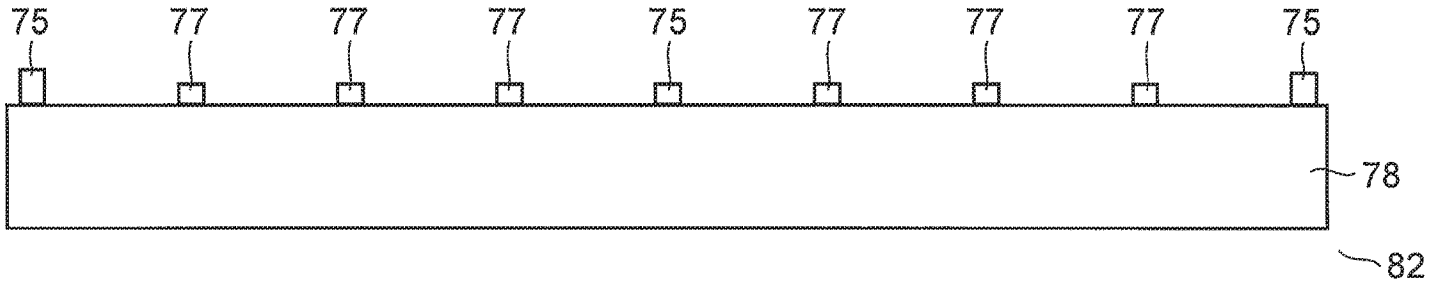

FIG. 11A is a view of the treatment solution receiving member 82 that is seen from an inner side. In this embodiment, the gripping projection 75 is provided at three positions of right and left ends and a central portion. In addition, adhesion prevention projections 77 are provided between the adjacent gripping projections 75. FIG. 11B is a bottom view of FIG. 11A. As it is apparent from this drawing, the adhesion prevention projections 77 are formed to be lower than the gripping projections 75. Accordingly, the upper end of the substrate 54 is sandwiched and held by the gripping projections 75.

Note that the adhesion prevention projections 77 are provided to prevent the substrate 54 from being bent (easily bent in a case of a thin substrate) and adhering to the treatment solution receiving member 82 in portions not provided with the gripping projections 75. In the cases where the substrate 54 adheres to the treatment solution receiving member 82 and an adhering area thereof is large, the substrate 54 remains adhering thereto even when the treatment solution flows thereto. As a result, the surface treatment cannot be performed in an adhering portion.

Figure 5:
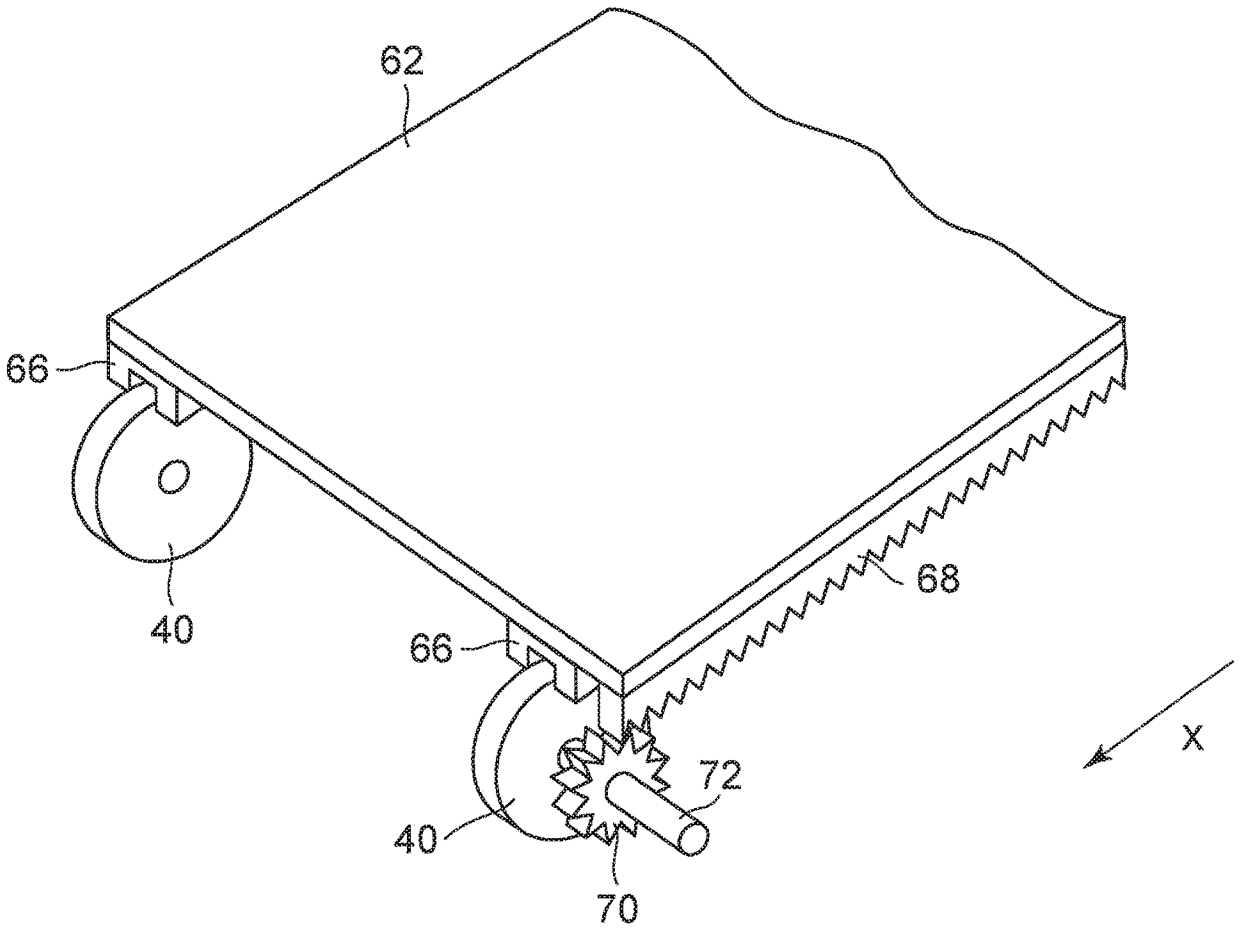
FIG. 5 is a view of roller guides 66 and a rack 68 of a top plate 62.

As shown in FIG. 5, a roller guide 66 is provided at each end on a lower side of a back surface of the top plate 62. Furthermore, a rack 68 is provided at the one end. A roller 40 is rotatably fitted to a recessed section of the roller guide 66. A pinion 70 is provided on the same rotary shaft 72 as the roller 40 and meshes with the rack 68. The rotary shaft 72 is rotationally driven by a motor (not shown) and causes movement of the top plate 62 in an arrow X direction. In this way, the substrate 54 that is held by the hanger 50 is successively moved through the treatment sections.

Returning to FIG. 4, the treatment solution is supplied to the pipe 56 by the pump 60 in FIG. 3. This treatment solution differs by the treatment section. In this embodiment, a cleaning solution is used in the first cleaning section 24, the second cleaning section 28, the third cleaning section 32, and the fourth cleaning section 36. A desmear solution is used in the desmear section 26. A pretreatment solution is used in the pretreatment section 30. A plating solution is used in the electroless copper-plating section 34.

The hole 58 of the pipe 56 is provided to face upward at a specified angle (for example, 45 degrees). Accordingly, the treatment solution is released obliquely upward from the pipe 56 and reaches the clip 52. Note that the hole 58 is preferably directed in a range from 5 degrees to 85 degrees with respect to a horizontal direction. The hole 58 of the pipe 56 is provided at specified intervals (for example, intervals of 10 cm) in the perpendicular direction to the sheet.

Figure 8A:
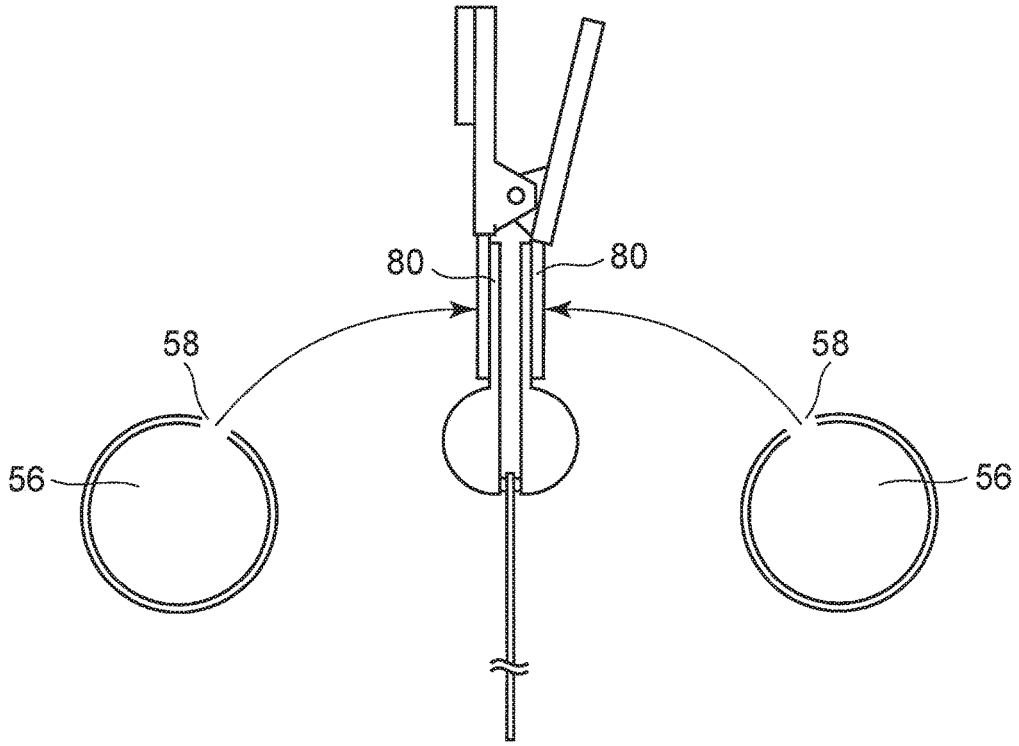
FIG. 8A is a view of a state where a treatment solution is released from pipes 56.
Figure 8B:
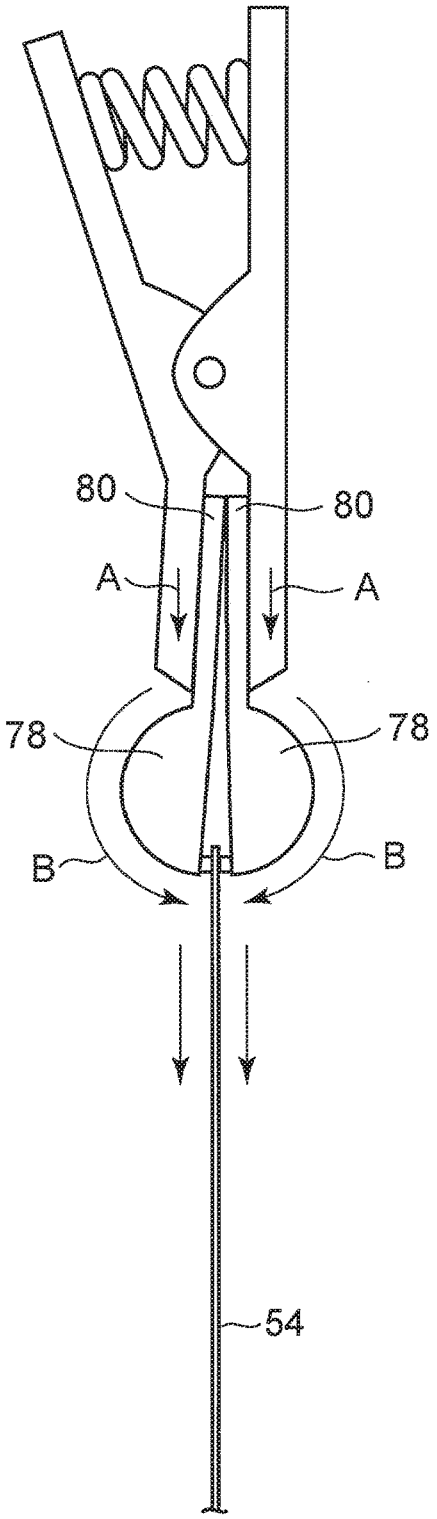
FIG. 8B is a view of a flow of the treatment solution in a treatment solution receiving member 82.

As shown in FIG. 8A, the treatment solution that is jetted out of the hole 58 of the pipe 56 abuts against the flat plate 80 of the treatment solution receiving member 82 and flows in the downward direction. The flow of the treatment solution at this time is shown in FIG. 8B. The treatment solution that has abutted against the flat plate 80 flows on a surface of the flat plate 80 in an arrow A direction (the downward direction) while being spread laterally. As described above, the treatment solution is released at the specified intervals from the pipe 56, and the treatment solution that has abutted against the flat plate 80 is spread laterally. Accordingly, the treatment solution flows in the downward direction across an entire surface of the flat plate 80 in a width direction.

As indicated by an arrow B, the treatment solution that has flowed down on the surface of the flat plate 80 flows on a surface of the projected section 78 with a semi-circular cross section. The treatment solution that has reached a lower end of the projected section 78 flows down on the substrate 54. Accordingly, the treatment solution flows on the entire surface of the substrate 54, and the surface treatment is thereby performed.

Figure 9A:
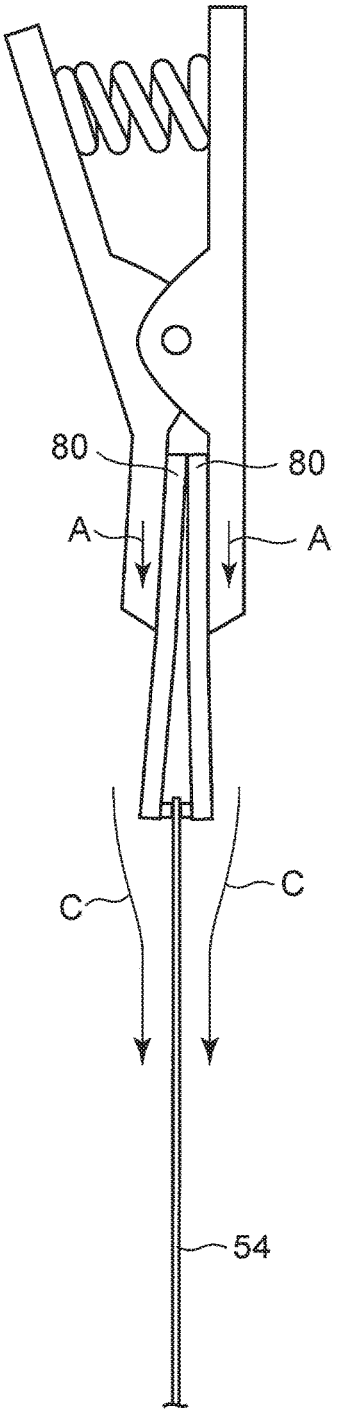
FIGS. 9A and 9B include views of other shapes of the treatment solution receiving member 82.

Note that, when the treatment solution flows from the treatment solution receiving member 82 to the substrate 54, as shown in FIG. 8B, the treatment solution preferably flows onto the surface thereof at a substantially perpendicular angle. As shown in FIG. 9A, when flowing onto the surface thereof at a substantially horizontal angle, this solution rinses off an agent that is applied onto the surface of the substrate 54 (for example, vanadium during plating), and thus the appropriate surface treatment cannot be performed.

Figure 9B:
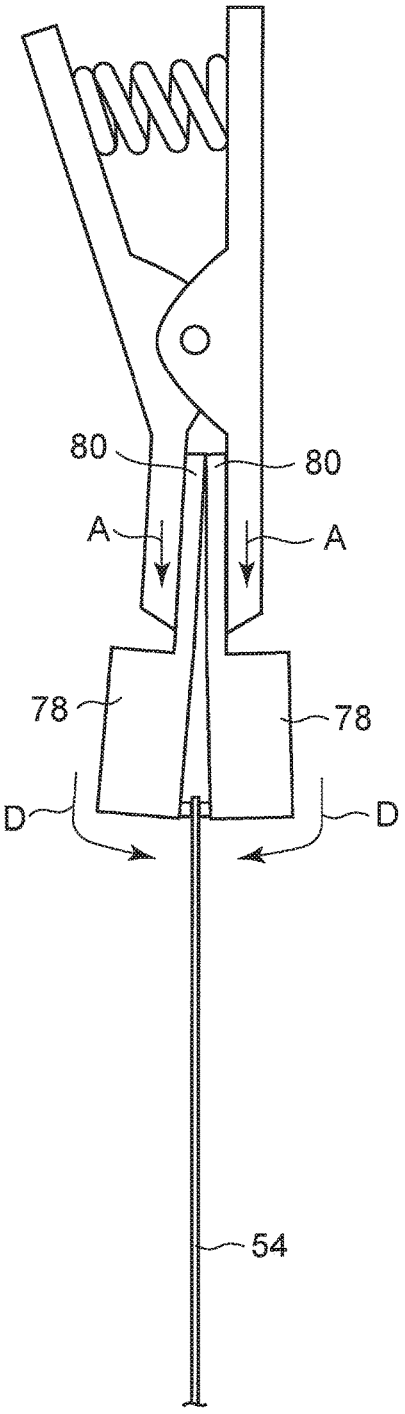

Thus, as shown in FIG. 9B, the projected section 78 is preferably provided to cause the treatment solution to flow onto the surface of the substrate 54 at the substantially perpendicular angle. However, in a case of a structure as shown in FIG. 9B, the treatment solution may not sufficiently flow around the projected section 78 in an upper portion of the substrate 54, which possibly results in uneven application of the treatment solution. To handle this problem, in the above embodiment, the projected section 78 has an R shape (a curved surface shape), so as to allow the treatment solution to reliably flow therearound and thus to realize flowing of the treatment solution at the substantially perpendicular angle.

Figure 10A:
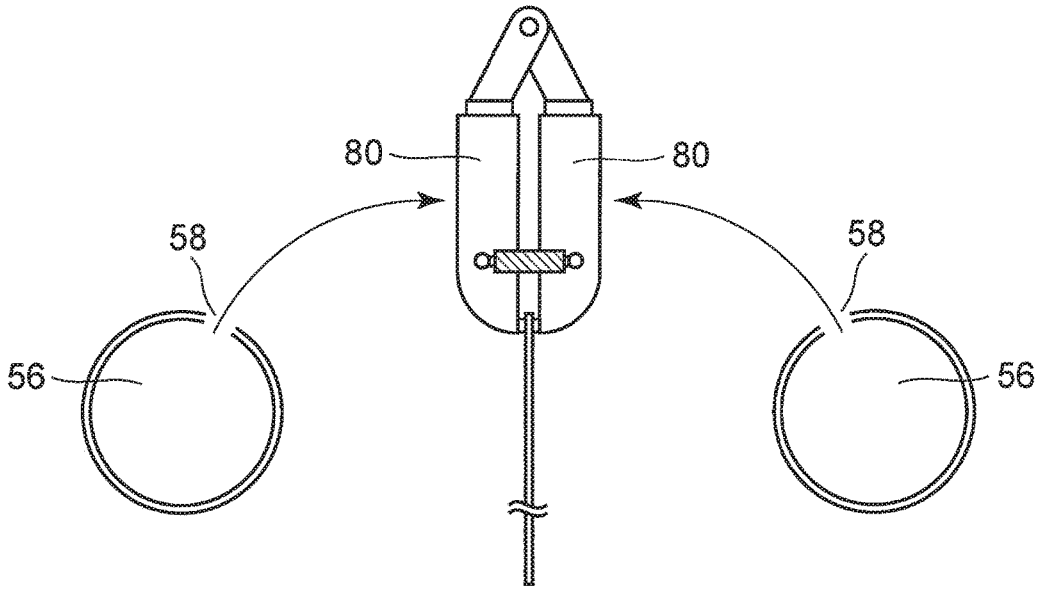
FIGS. 10A and 10B include views of other shapes of the treatment solution receiving member 82.

For example, a similar effect may be achieved by providing an R portion at a lower outer end of the projected section 78 in FIG. 9B. Alternatively, as shown in FIG. 10A, the flat plate 80 may be formed thick (preferably having thickness of 20 mm to 40 mm), and an R portion (preferably R=10 mm or larger) may be provided at an outer tip thereof.

Figure 10B:
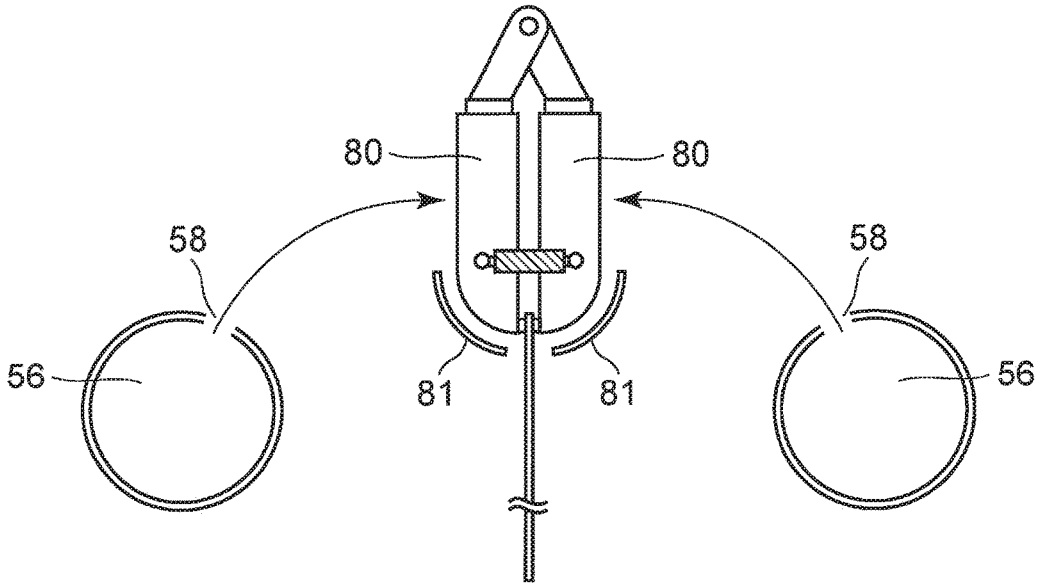

Furthermore, as shown in FIG. 10B, a flow guide 81 may be provided. The treatment solution reliably flows toward the substrate 54 by this flow guide 81. Even in a structure as shown in FIG. 9B, the treatment solution can reliably flow toward the substrate 54 by using the flow guide 81.

In addition, near the lower end of the projected section 78, the treatment solution that has flowed therearound slightly moves in an upward direction. Thus, the treatment solution is spread to the upper end of the substrate 54. At this time, as shown in FIG. 11B, due to provision of the adhesion prevention projections 77, even when the substrate 54 is bent, the substrate 54 does not adhere to the treatment solution receiving member 82 and only contacts the adhesion prevention projections 77. Accordingly, the treatment solution that has flowed separates the substrate 54 from the adhesion prevention projection 77 and causes the substrate 54 to float thereon. In this way, the surface treatment can be performed evenly to the upper end of the substrate 54.

Note that the adhesion prevention structure shown in FIGS. 11A and 11B can be applied not only to a method of making the treatment solution abut against the hanger 50 and flow on the substrate 54 but also to a method of making the treatment solution abut against a portion near the upper end of the substrate 54 and flow thereon.

Note that, as shown in FIG. 1, cleaning treatment is performed before (after) desmear treatment, pretreatment, and electroless copper-plating treatment. Also, in the cleaning treatment, cleaning solution as the treatment solution flows to clean the surface of the substrate 54 in a similar manner to what has been described above. However, in the cleaning treatment, the position at which the treatment solution released from the pipe 56 abuts against the substrate 54 is set above (to be higher than) an abutment position thereof in the desmear treatment, the pretreatment, and the electroless copper-plating treatment. In this way, in the cleaning treatment, a desmear treatment solution, the pretreatment solution, and an electroless copper-plating treatment solution that adhere to the flat plate 80 can be further appropriately rinsed off.

Figure 12:
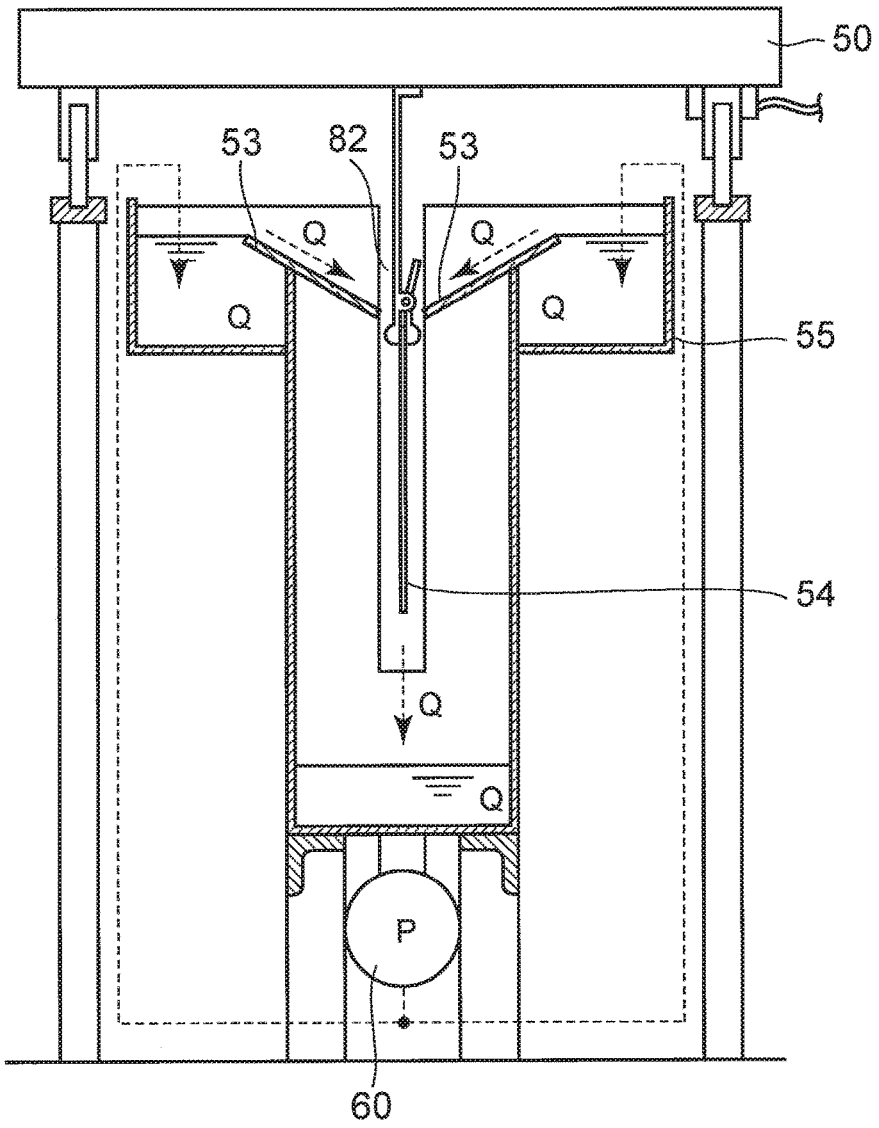
FIG. 12 is a view of a structure of a treatment solution releasing section according to another embodiment.

In addition, in the above embodiment, the treatment solution is released obliquely upward from the pipe 56. However, as shown in FIG. 12, the treatment solution may be released obliquely downward from a slope 53. In a reservoir 55, the treatment solution that has been pumped by the pump 60 is stored. When a solution surface becomes higher than an end of the slope 53, the treatment solution overflows onto the slope 53. The treatment solution that has overflowed onto the slope 53 abuts against the treatment solution receiving member 82 and flows down on the substrate 54. In this case, the slope 53 corresponds to the treatment solution releasing section.

In the above embodiment, it is configured that the hanger 50 moves with respect to the pipe 56 and the reservoir 55. However, the hanger 50 may be fixed, and the pipe 56 and the reservoir 55 may move.

2. Second Embodiment

In the first embodiment, the structure of the one hanger 50 that causes the treatment solution to appropriately flow on the substrate 54 has been described. A second embodiment, which will be described below, relates to a case where the plural hangers 50 respectively hold the substrates 54 and the treatment solution flows on these substrates 54 as a group.

In order to simplify a description, a case where the plural hangers 50 are applied to the surface treatment device of the first embodiment will be described below. However, the plural hangers 50 can be applied to any surface treatment device as long as a method of causing the treatment solution to flow on the surface of the substrate 54 is adopted therefor.

Figure 13:
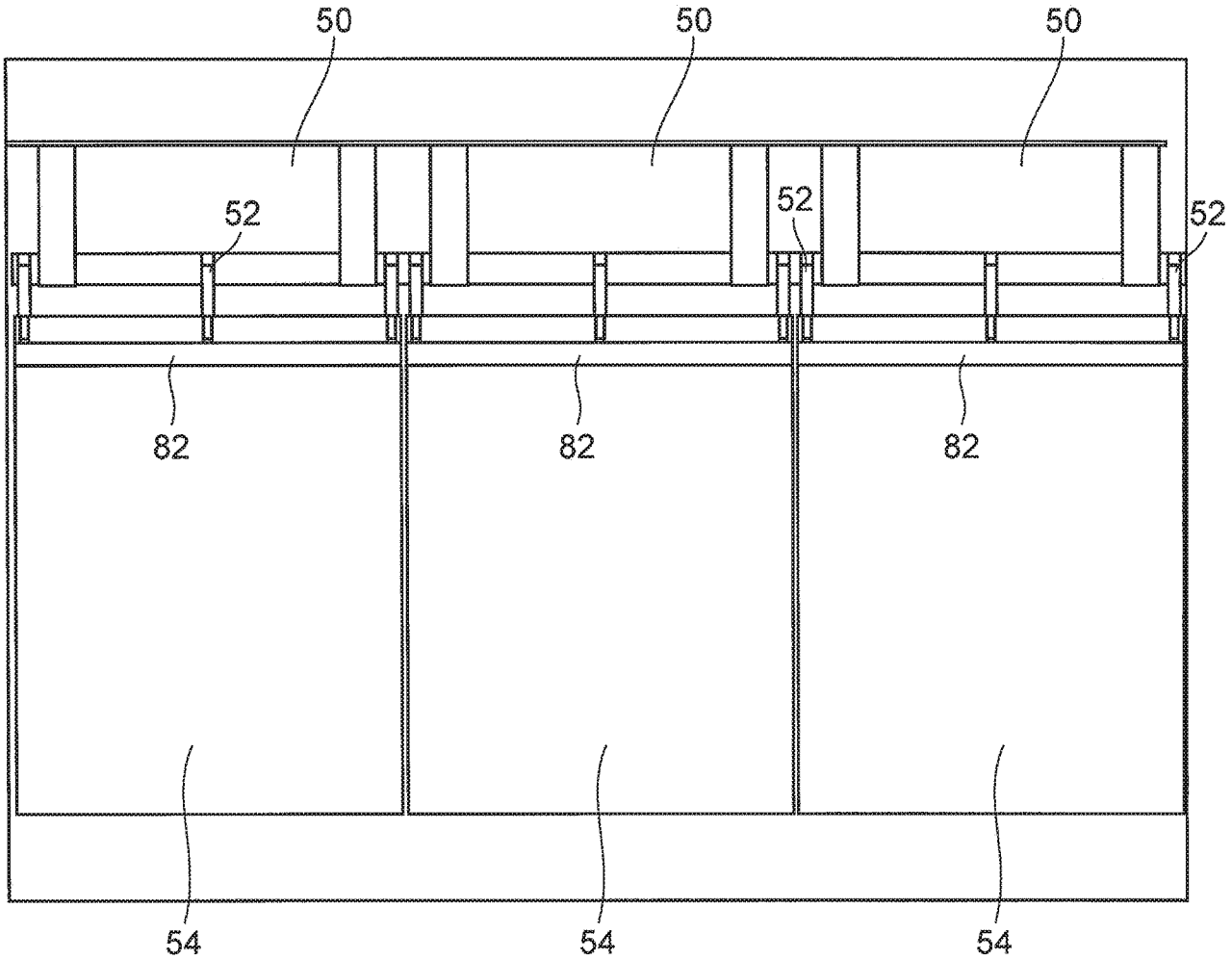
FIG. 13 is a view of the successively-arranged hangers 50 and retained substrates 54.

FIG. 13 shows a state where the plural substrates 54, which are respectively held by the hangers 50, are arranged. The substrate 54 is held across the width of the hanger 50. Treatment capacity is increased when a clearance between the adjacent substrates 54 is reduced to be as narrow as possible. In this embodiment, the clearance of 5 mm to 15 mm is provided. It is difficult to reduce this clearance between the substrates 54 to 0 mm. This is because, when an error occurs to a transporting speed of each of the hangers, the adjacent substrates 54 overlap and adhere to each other, which possibly leads to twisting and tearing of the substrates 54.

In addition, a clearance of 5 mm to 15 mm is also provided between the hanger 50 and the hanger 50. This is because, when feeding speeds of the hangers 50 do not match completely, the hangers 50 come in contact with each other, the hangers 50 are tilted, and the adjacent substrates 54 possibly come in contact with each other. Needless to say, when the feeding speed of each of the hangers 50 is set to be precisely constant, this clearance can be reduced. However, a complicated and expensive mechanism becomes necessary.

Just as described, the specified clearance has to be provided between the adjacent hangers 50 and between the adjacent substrates 54. Under normal circumstances, the treatment solution does not have to flow between the substrate 54 and the substrate 54. This is because the substrate 54 is not provided in such a portion and thus the surface treatment using the treatment solution is unnecessary.

Figure 14:
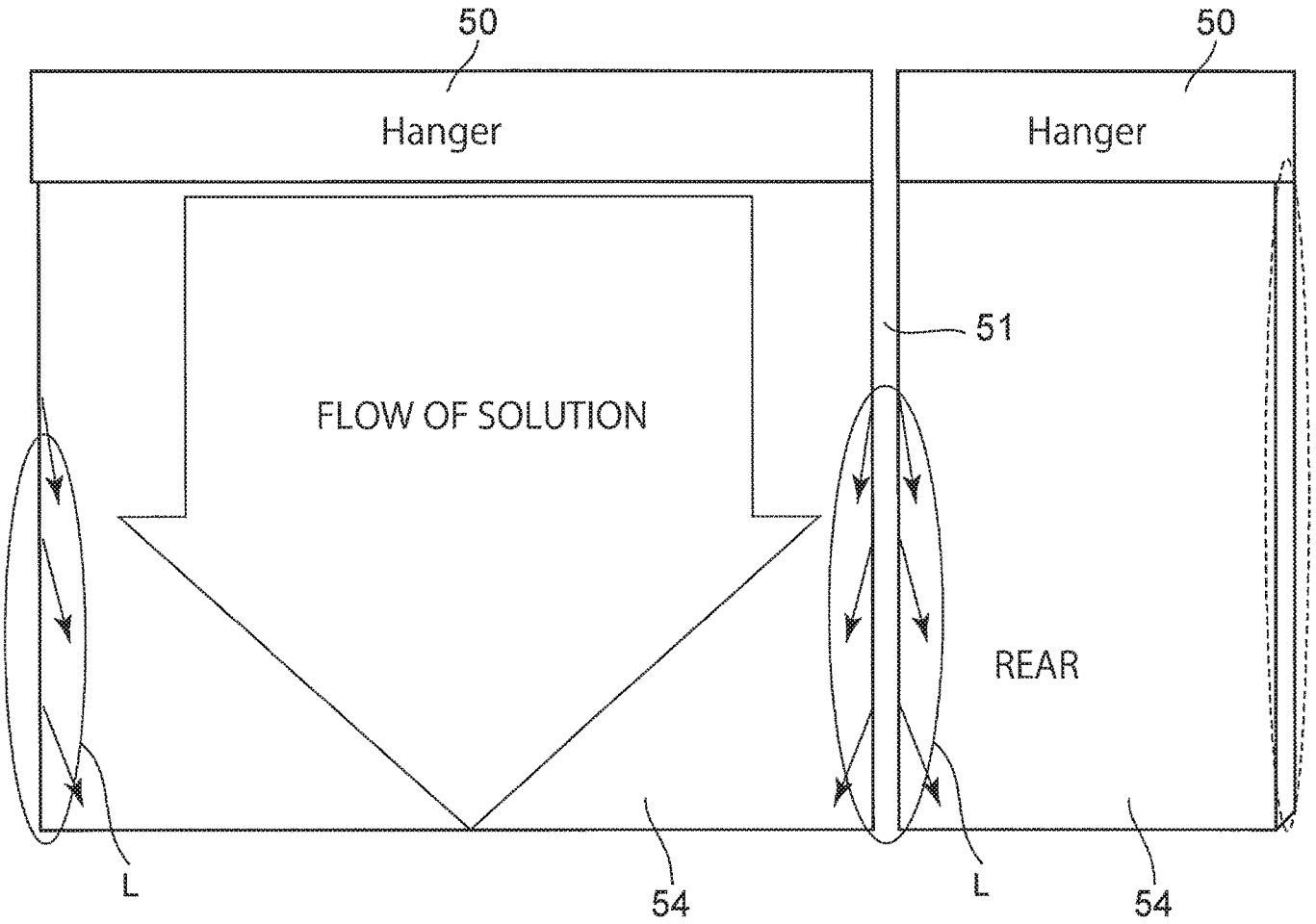
FIG. 14 is a view of a flow of the solution in FIG. 13.

However, as schematically shown in FIG. 14, because the treatment solution does not flow through a space 51 between the hanger 50 and the hanger 50, a quantity of the treatment solution that flows on an end is reduced in a lower portion L of the substrate 54 due to surface tension. This leads to a problem of the uneven surface treatment of the substrate 54.

Figure 15:
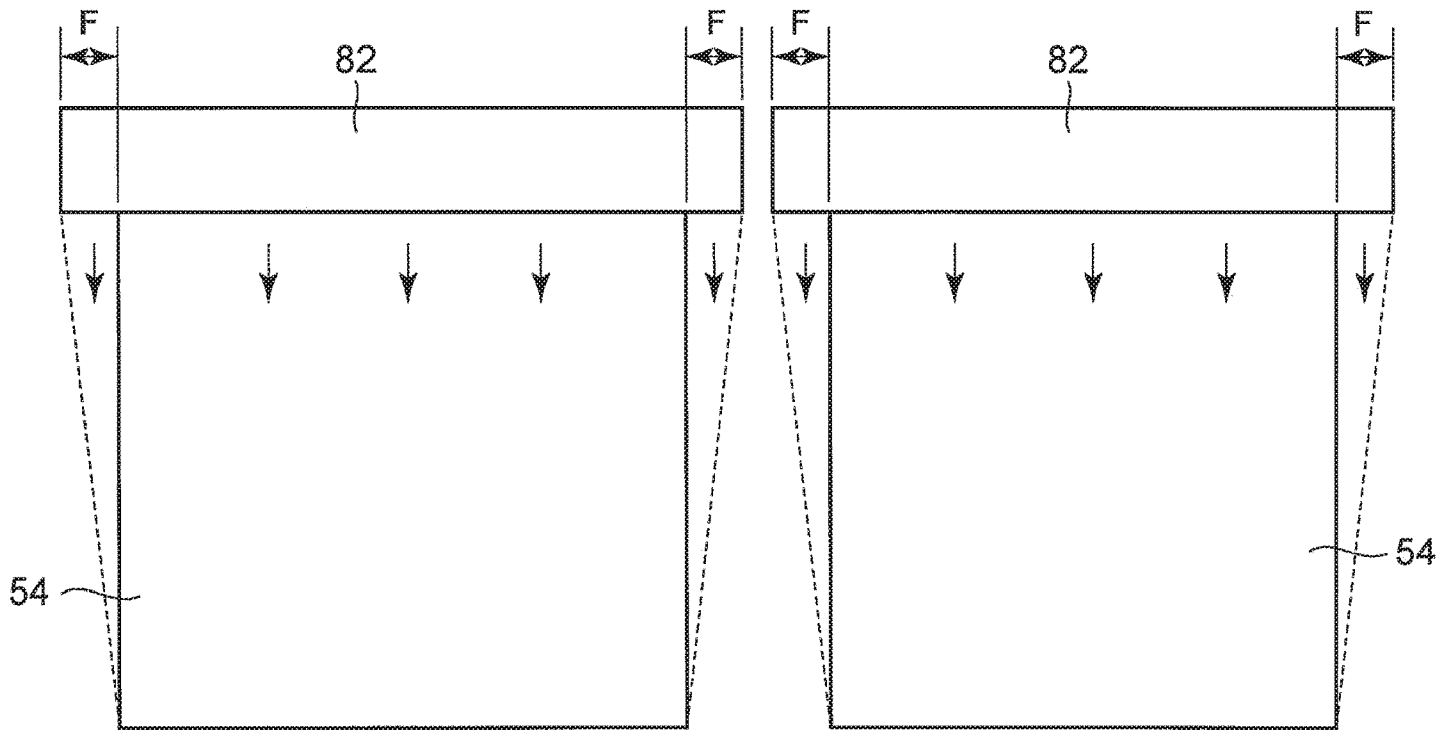
FIG. 15 is a view of a flow of the treatment solution at a time when the hangers 50 are projected.

To handle this problem, in this embodiment, a structure that causes the treatment solution to flow through spaces on outer sides of right and left ends of the substrate 54 is adopted. FIG. 15 shows an example of such a structure. In this example, the treatment solution receiving member 82 of the hanger 50 is wider than the substrate 54. Accordingly, as indicated by arrows in the drawing, the treatment solution also flows on the outer sides of the substrate 54. A layer of this treatment solution approaches an end of the substrate 54 as flowing in the downward direction, and is eventually absorbed into the flow in the substrate 54. However, when a degree of projection F of the treatment solution receiving member 82 is substantially large, the layer of the treatment solution can be formed on the outer sides of the right and left ends of the substrate 54 up to the lower end thereof (see broken lines).

However, in the structure shown in FIG. 15, the large clearance is provided between the substrate 54 and the substrate 54. Thus, the number of the substrates 54 that can be treated per unit time is reduced. When a yield of the treatment becomes problematic just as described, the treatment solution receiving member 82 may adopt a structure as shown in FIG. 16.

Figure 16:
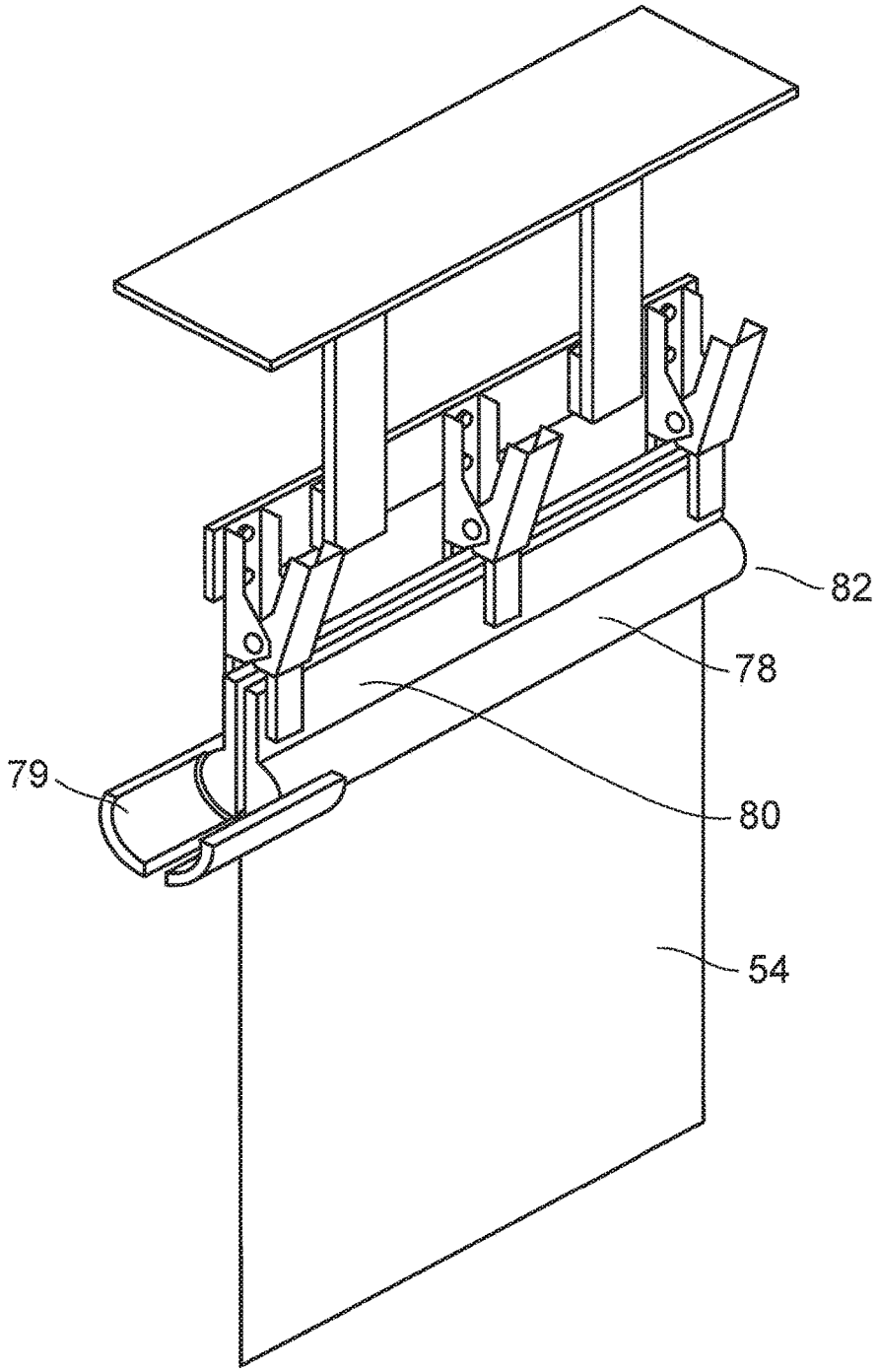
FIG. 16 is a view of a state where a guide member 79 is provided.
Figure 17C:
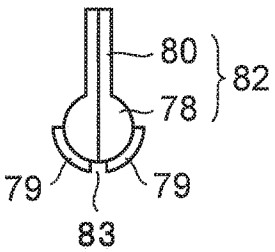
FIGS. 17A, 17B, and 17C include detailed views of the guide member 79.
Figure 17A:
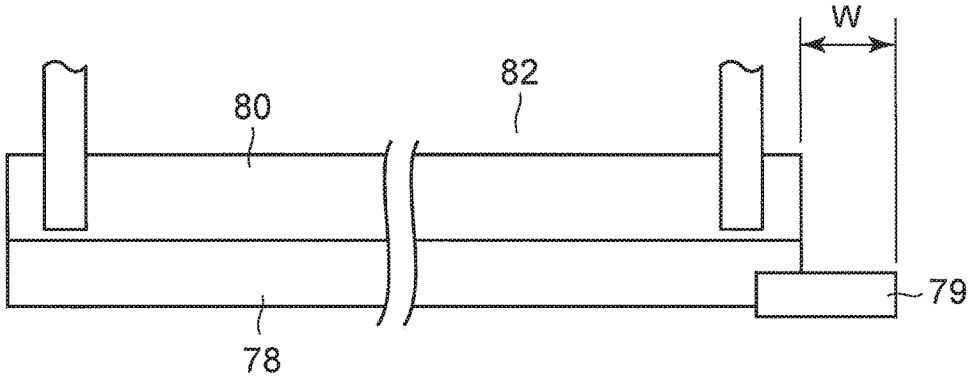
Figure 17B:
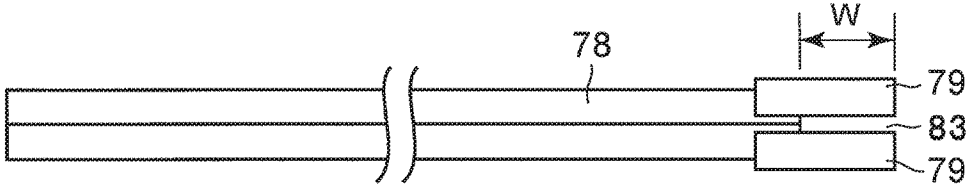

In FIG. 16, a guide member 79 is provided on one side of the projected section 78 in the treatment solution receiving member 82. FIG. 17A is a front view thereof, FIG. 17B is a bottom view thereof, and FIG. 17C is a side view thereof.

The guide member 79 is provided on an outer side of the projected section 78 in a manner to follow an outer shape thereof. In this embodiment, the guide member 79 is provided along a lower half of the R portion of the projected section 78. The guide member 79 does not completely cover a lower side of the projected section 78 but is provided such that a space 83 is produced at the lower end thereof. In addition, the guide member 79 is provided in a manner to be projected by W from the width of the projected section 78.

Figure 18:
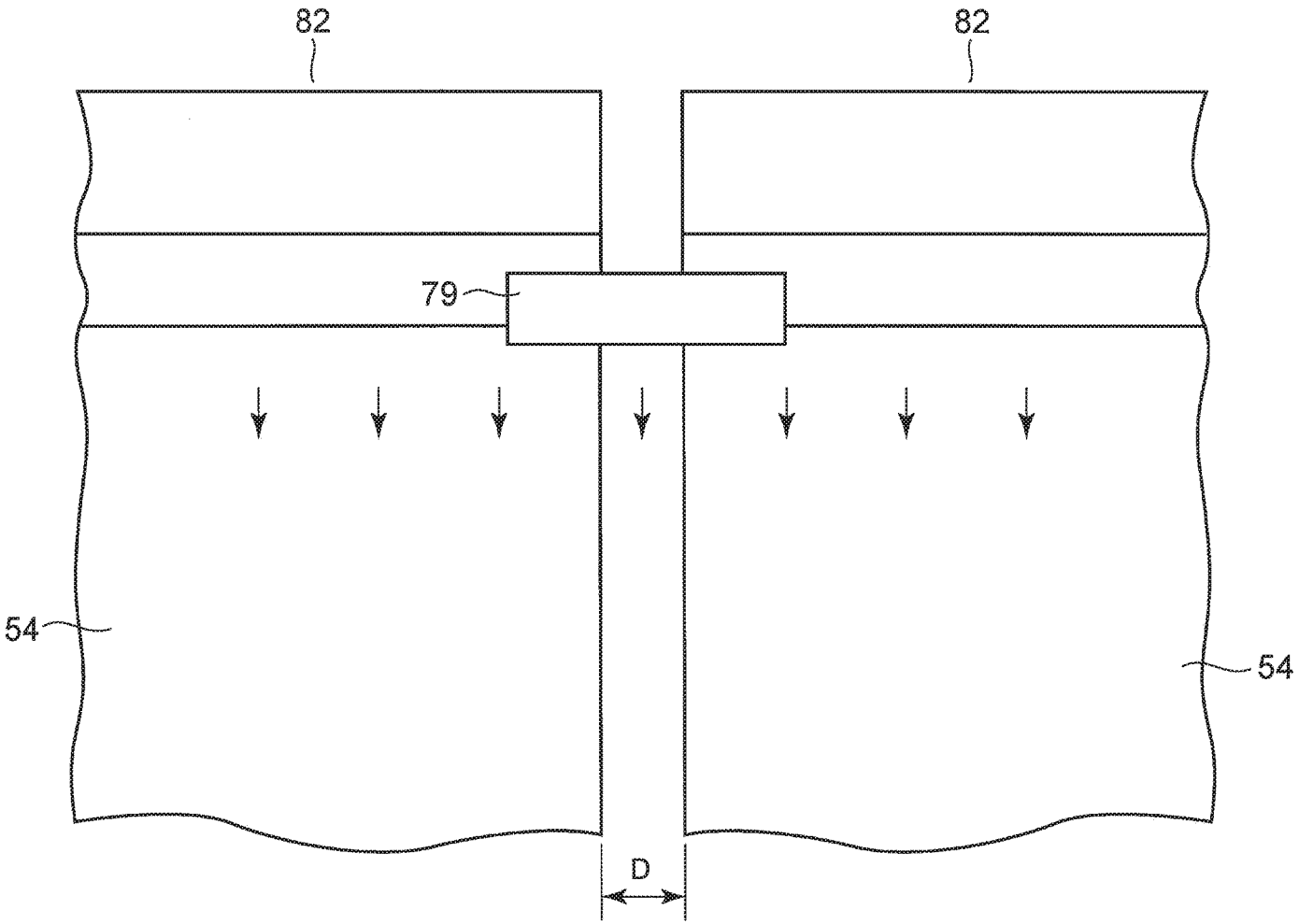
FIG. 18 is a view that explains a function of the guide member 79.

FIG. 18 shows states of the adjacent treatment solution receiving members 82 at a time when the plural hangers 50 are transferred. A front end of the rear (right) treatment solution receiving member 82 enters the guide member 79 that is provided at a rear end of the front (left) treatment solution receiving member 82. Furthermore, a front end of the rear (right) substrate 54 enters the space 83 (see FIG. 17C) of the front (left) guide member 79. In this way, the front end of the rear (right) substrate 54 overlaps a portion of the guide member 79 of the adjacent front (left) guide member 79. At this time, the treatment solution receiving members 82 of the hangers 50 and the substrates 54 are transferred with a specified gap D (5 mm to 15 mm in this embodiment) being interposed therebetween. At this time, the treatment solution that has been released from the pipe 56 is received by the guide member 79 and is dropped from the space 83 (see FIG. 17C) toward the gap D. Accordingly, a film of the treatment solution is formed in a portion corresponding to the gap D. Thus, while the problem as shown in FIG. 14 is solved, the surface treatment with little unevenness can be realized.

As it has been described so far, according to the embodiment shown in FIG. 18, the surface treatment with little unevenness can be performed without increasing the gap between the substrates 54. Note that the guide member 79 is provided on the only one side of the treatment solution receiving member 82 in the above description. However, the hanger 50 that is provided with the guide members 79 on both of the sides and the hanger 50 that is not provided with the guide member 79 may alternately be arranged for use.

Figure 19C:
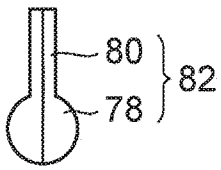
FIGS. 19A, 19B, and 19C include views of the structure of the treatment solution receiving member 82 according to another embodiment.
Figure 19A:
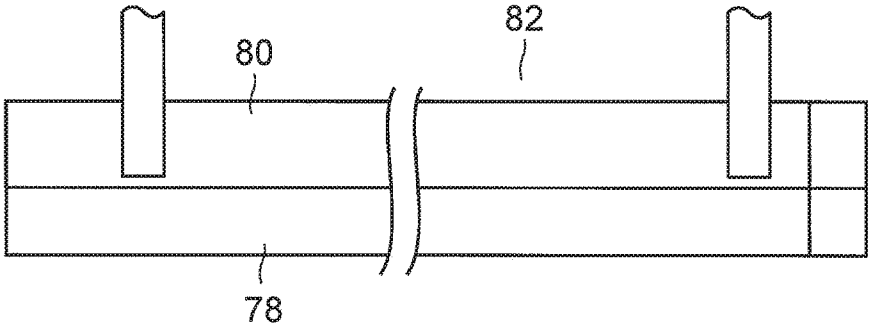
Figure 19B:
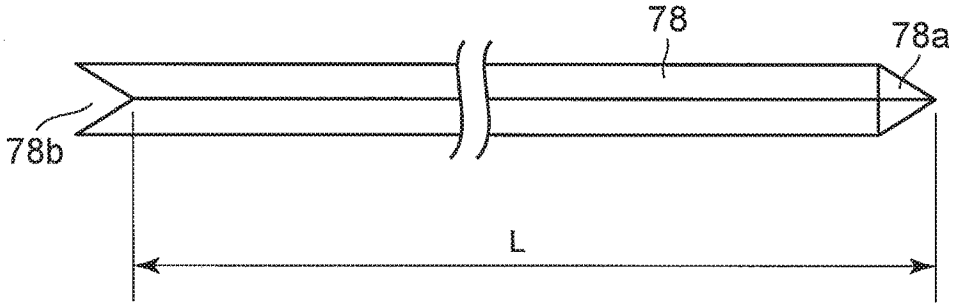

In addition, as shown in FIG. 19, a projected section 78*a* may be formed by tapering one side of the treatment solution receiving member 82 (the projected section 78) as a point, and a recessed section 78*b* that corresponds thereto may be formed on an opposite side. FIG. 19A is a front view thereof, FIG. 19B is a bottom view thereof, and FIG. 19C is a side view thereof. In this case, the substrate 54 may be attached across length L in FIG. 19B. The projected section 78*a* of the hanger 50 enters the recessed section 78*b* of the adjacent hanger 50 (however, a gap of 5 mm to 15 mm is provided to avoid abutment). In this way, the layer of the flow of the treatment solution can also be formed between the substrate 54 and the substrate 54.

Note that the projected section 78*a*, which is tapered and pointed, and the recessed section 78*b*, which corresponds thereto, are provided in FIG. 19. However, as long as the projected section and the recessed section have such shapes that one enters the other, any shape can be adopted therefor. For example, the columnar projected section 78*a*, the recessed section 78*b* in a corresponding shape thereto, or the like may be used.

Figure 20C:
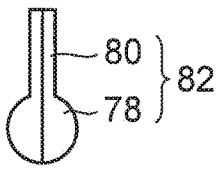
FIGS. 20A, 20B, and 20C include views of the structure of the treatment solution receiving member 82 according to yet another embodiment.
Figure 20A:
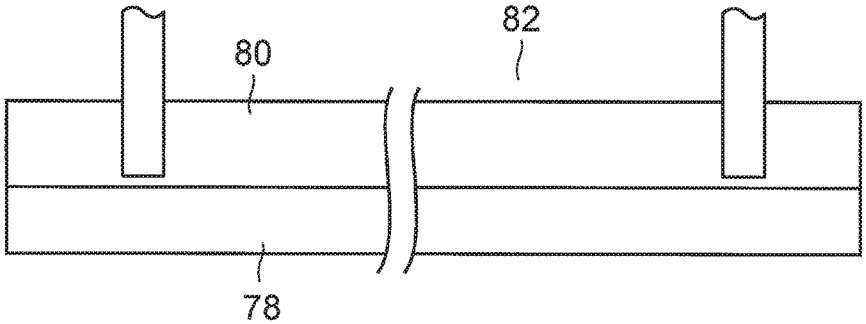
Figure 20B:
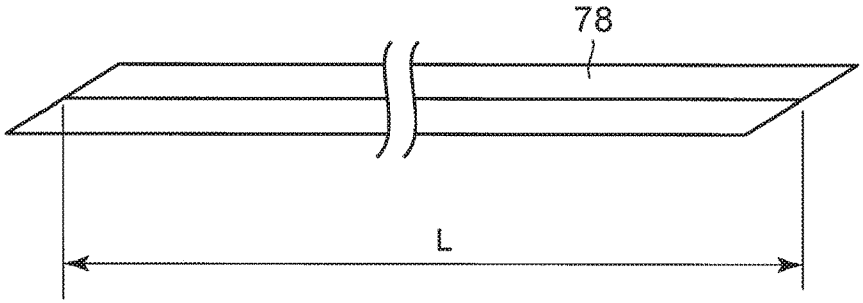

In addition, as shown in FIG. 20, both ends of the treatment solution receiving member 82 (the projected section 78) may be formed obliquely. FIG. 20A is a front view thereof, FIG. 20B is a bottom view thereof, and FIG. 20C is a side view thereof.

Figure 21C:
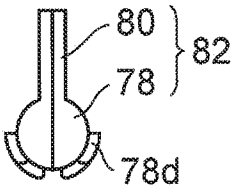
FIGS. 21A, 21B, and 21C include views of the structure of the treatment solution receiving member 82 according to further another embodiment.
Figure 21A:
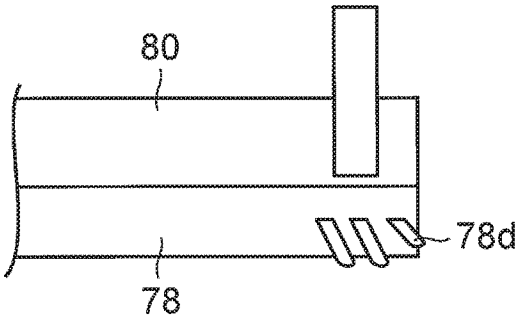
Figure 21B:
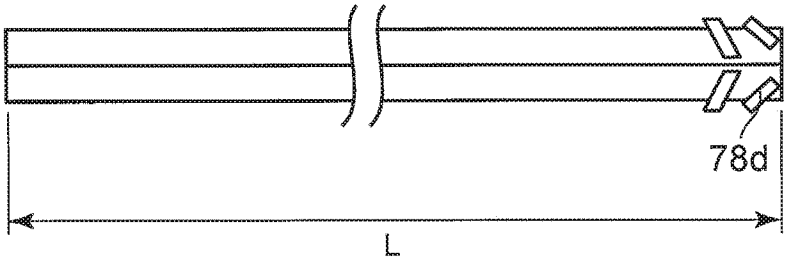

Furthermore, as shown in FIG. 21, projections 78*d* for drift may be provided at both of the ends of the treatment solution receiving member 82 (the projected section 78). FIG. 21A is a front view thereof, FIG. 21B is a bottom view thereof, and FIG. 21C is a side view thereof. In this way, at both of the ends, the treatment solution is drifted to the outer side, and thus the treatment solution can flow through a space between the substrate 54 and the substrate 54.

In the above embodiment, the description has been made on the thin substrate (with thickness of several tens of μm), which cannot stand alone as a natural state, as a treatment target. However, a thick substrate can also be the treatment target.

The second embodiment can be implemented in combination with the first embodiment but can also be implemented independently from the first embodiment.

A general description of the present invention as well as preferred embodiments of the present invention has been set forth above. It is to be expressly understood, however, the terms described above are for purpose of illustration only and are not intended as definitions of the limits of the present invention. Those skilled in the art to which the present invention pertains will recognize and be able to practice other variations in the system, device, and methods described which fall within the teachings of this invention. Accordingly, all such modifications are deemed to be within the scope of the present invention.

Figure 22:
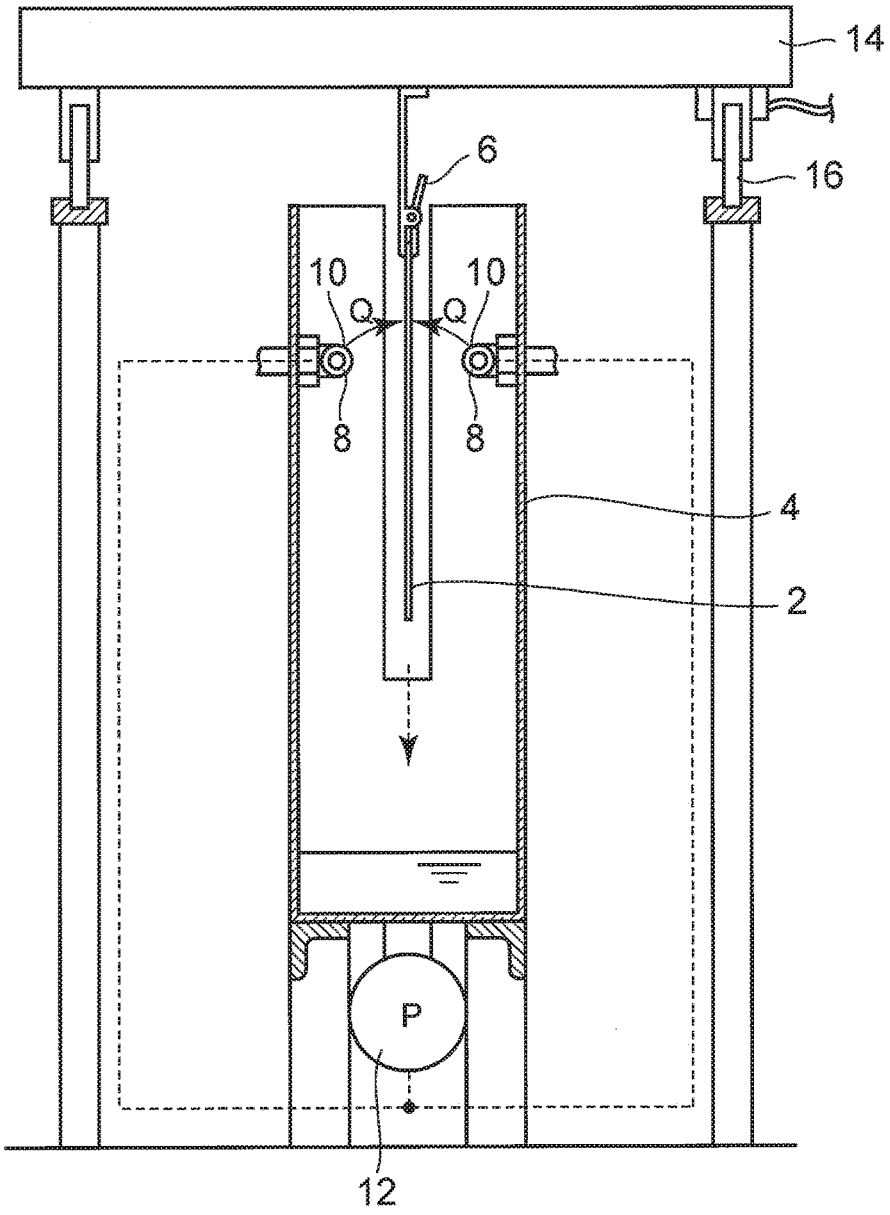
FIG. 22 is a view of an example of a conventional surface treatment device.

FIG. 1
22/Loading Section
24/First Cleaning Section
26/Desmear Section
28/Second Cleaning Section
30/Pretreatment Section
32/Third Cleaning Section
34/Electroless Copper-Plating Section
36/Fourth Cleaning Section
38/Unloading Section
FIG. 14
1/Flow Of Solution
2/Rear

What is claimed is:

1. A surface treatment device comprising:

a holding member that holds an upper portion of a treatment target;

a treatment solution releasing section that releases a treatment solution from a pipe onto the holding member and causes the treatment solution to flow down and onto a surface of the treatment target held by the holding member, the treatment solution releasing section being provided in a tank, the treatment solution releasing section releasing the treatment solution, wherein the treatment solution does not fill the tank; and a transferring mechanism that changes a relative position of the treatment target, which is held by the holding member, to the treatment solution releasing section.

2. The surface treatment device according to claim 1, wherein:

at least a part of the holding member has such thickness that, when flowing on a surface of the holding member toward the treatment target, the released treatment solution flows perpendicularly with respect to the surface of the treatment target and reaches the treatment target.

3. The surface treatment device according to claim 2, wherein:

a corner of a lower end of the holding member that holds the treatment target has a curved surface shape in a cross section.

4. The surface treatment device according to claim 2, wherein:

a lower end of the holding member that holds the treatment target has a semi-circular shape in a cross section.

5. The surface treatment device according to claim 1, wherein:

a plurality of holding members are provided and are configured such that a plurality of treatment targets are transferred with a specified space being interposed therebetween, and the plurality of the holding members are configured such that the treatment solution also flows through the space between the treatment targets.

6. The surface treatment device according to claim 5, wherein:

the plurality of the holding members are configured such that each holding member is also located in an upper portion of the space between the adjacent treatment targets.

7. The surface treatment device according to claim 6, wherein:

the plurality of the holding members are configured such that an end of the treatment target overlaps a part of the adjacent holding member of the plurality of holding members.

8. The surface treatment device according to claim 5, wherein:

a guide is provided at an end of each of the plurality of holding members such that the treatment solution flows toward the treatment target held by the adjacent holding member.

9. The surface treatment device according to claim 1, wherein:

the treatment target is a thin plate, and the holding member is configured to sandwich the thin plate from both sides, is provided with gripping projections to sandwich the thin plate on inner sides, and is provided with an adhesion prevention projection to avoid adhesion of the thin plate to the holding member.

10. The surface treatment device according to claim 1, wherein:

the treatment solution releasing section is provided at a plurality of positions in a transferring direction of the treatment target, at least one of the treatment solution releasing sections releases a plating solution, and at least another one thereof releases a cleaning solution, and the treatment solution releasing sections are configured that a position where the treatment solution releasing section releasing the plating solution applies the plating solution to the holding member is lower than a position where the treatment solution releasing section releasing the cleaning solution applies the cleaning solution to the holding member.

11. A surface treatment device comprising:

a holding member that holds an upper portion of a treatment target;

a treatment solution releasing section that causes a treatment solution to flow from a pipe onto a surface of the treatment target held by the holding member; and a transferring mechanism that changes a relative position of the treatment target held by the holding member with respect to the treatment solution releasing section, wherein a plurality of the holding members are provided and are configured such that the treatment targets are transferred with a specified space being interposed therebetween, and wherein the treatment solution also flows through the space between the treatment targets and the treatment solution releasing section is provided in a tank, the treatment solution releasing section releasing the treatment solution, wherein the treatment solution does not fill the tank.

* * * * *